US009453288B2

(12) United States Patent
Tomlinson

(10) Patent No.: US 9,453,288 B2
(45) Date of Patent: Sep. 27, 2016

(54) TORQUE WRENCH HAVING IMPROVED WEAR PROPERTIES

(71) Applicant: Snap-on Incorporated, Kenosha, WI (US)

(72) Inventor: Timothy D Tomlinson, Rowland Heights, CA (US)

(73) Assignee: Snap-on Incorporated, Kenosha, WI (US)

( * ) Notice: Subject to any disclaimer, the term of this patent is extended or adjusted under 35 U.S.C. 154(b) by 297 days.

(21) Appl. No.: 14/300,864

(22) Filed: Jun. 10, 2014

(65) Prior Publication Data

US 2015/0354079 A1 Dec. 10, 2015

(51) Int. Cl.

| | |
|---|---|
| ***C25D 7/00*** | (2006.01) |
| ***B25B 23/142*** | (2006.01) |
| ***C25D 7/04*** | (2006.01) |
| ***C25D 5/34*** | (2006.01) |

(52) U.S. Cl.

CPC ..... *C25D 7/00* (2013.01); *B25B 23/1427* (2013.01); *C25D 5/34* (2013.01); *C25D 7/04* (2013.01)

(58) Field of Classification Search

CPC ..... C25D 7/00; C25D 7/04; B25B 23/1427; B25B 23/141; B25B 23/142

See application file for complete search history.

(56) References Cited

U.S. PATENT DOCUMENTS

| | | | | |
|---|---|---|---|---|
| 4,485,703 | A * | 12/1984 | Grabovac | B25B 23/1427 81/483 |
| 6,807,885 | B2 * | 10/2004 | Loper | B25B 23/1427 81/478 |
| 8,267,203 | B2 | 9/2012 | Oxford | |
| 2011/0036214 | A1 | 2/2011 | Potterfield | |
| 2013/0306185 | A1 * | 11/2013 | Mackay | C25D 5/022 138/146 |

* cited by examiner

*Primary Examiner* — David B Thomas

(57) ABSTRACT

A method for improving wear properties of a torque wrench includes electroplating one or more components of the torque wrench with zinc. In an aspect, one or more of an interior surface of a tube component, a surface of a secondary arm, a surface of a cam, and a surface of a pawl components may be electroplated with zinc. These components may interact to provide a click mechanism. For example, the pawl component may be seated between the secondary arm and the cam components, and the cam is adapted to move against a bias force when the secondary arm shifts the pawl in response to a preset torque level being achieved. The electroplated zinc layer provides a corrosion-resistant, softer and smoother surface for these components, and serves as a frictional reducer when the zinc oxidizes to form zinc oxide, which improves the accuracy life of the tool.

20 Claims, 8 Drawing Sheets

TORQUE WRENCH HAVING IMPROVED WEAR PROPERTIES

FIELD

The present application relates generally to torque wrenches and, in particular, to improved and methods of manufacturing torque wrenches to improve accuracy and longevity.

BACKGROUND

Common mechanical torque wrenches, such as mechanical click-type torque wrenches, generally include an elongated tubular lever arm coupled at one end to a head adapted to engage a workpiece and a handle at the other end. A "click" mechanism includes a spring-loaded cam disposed within the tube and biased toward a secondary arm. A pawl or trip block is seated between the secondary arm and cam in recesses formed in the facing ends of the secondary arm and cam. The spring force drives the cam axially against the pawl to hold the cam aligned with the secondary arm until an applied torque overcomes the spring force and causes the cam to shift rearwardly in the tube away from the secondary arm. When this happens a pivot arm of the head contacts an interior of the tube creating a tactile "click." When the torque is released, the spring causes the components to shift back to their original positions.

These common mechanical torque wrenches tend to excessively wear the cam, pawl, secondary arm, and tube interior due to their frictional interaction with one another. Current attempts at reducing this wear include using expensive specialty steel materials and heat treating. For example, it is known to construct the tube of ST52.3 steel and hardening via heat treating to 48-52 on a Rockwell C hardness scale (RC), construct the cam of a specialized powdered metal FC-0208-80HT and heat treating to 62 RC, construct the pawl of a specialized powdered metal FN-0208-105HT and heat treating to 62 RC, and construct the secondary arm of AISI 4140 steel and heat treating to 42-48 RC, in order to reduce wear and increase longevity. However, hardening of the components through the use of heat treating can cause distortion and degrade the surface finish of the components. This surface finish damage and distortion may require secondary processing operations to be performed, which add time and cost to the manufacturing process.

SUMMARY

The present application relates to a tool, such as a mechanical torque wrench having improved wear properties. In an aspect, one or more components of the tool are electroplated with zinc to improve the performance and life of the tool. In an aspect, a tube component of the tool may be made of a standard AISI or SAE 1018 and/or AISI or SAE 1020 steel, and the steel may be electroplated with zinc. Additional components, such as a secondary arm, a pawl, and a cam of the tool may also be electroplated. The electroplated zinc layer provides a corrosion-resistant, softer, and smoother surface for these components. Moreover, the electroplated zinc layer oxidizes to form zinc oxide, which reduces friction and improves the accuracy life of the tool.

In an aspect, a tool having improved wear properties includes a head adapted to engage a workpiece and a pivot arm, and a tube portion having an interior surface electroplated with a first zinc layer and adapted to receive the pivot arm and couple the head to the tube portion. Additional components may also be electroplated, such as components that interact with each other to provide a "click" sound when a preset torque level is achieved. For example, a secondary arm may have a surface electroplated with a second zinc layer and be disposed in the tube portion and adapted to couple to the pivot arm. A cam may have a surface electroplated with a third zinc layer and be disposed in the tube portion, and a bias member may be disposed in the tube portion and adapted to apply a bias force to the cam and bias the cam toward the secondary arm. A pawl may have a surface electroplated with a fourth zinc layer and be disposed in the tube portion and seated between the secondary arm and the cam. The cam is adapted to move against the bias force when the secondary arm shifts the pawl in response to a preset torque level being achieved, thereby causing a "click" sound.

In another aspect, a method for improving wear properties of a torque wrench may include zinc electroplating the surfaces of one or more of a tube component, a secondary arm component, a cam component, and a pawl component of the torque wrench. These components may interact to provide a click mechanism. For example, the tube component may be adapted to house the secondary arm, cam, and pawl components and couple to a head adapted to engage a workpiece. The secondary arm component may be adapted to couple to the head. The pawl component may be adapted to be seated between the secondary arm and cam components, and the tube, secondary arm, cam, and pawl components may be adapted to interact to provide the click mechanism. This improves the accuracy life of the tool or torque wrench.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION

Figure 1:
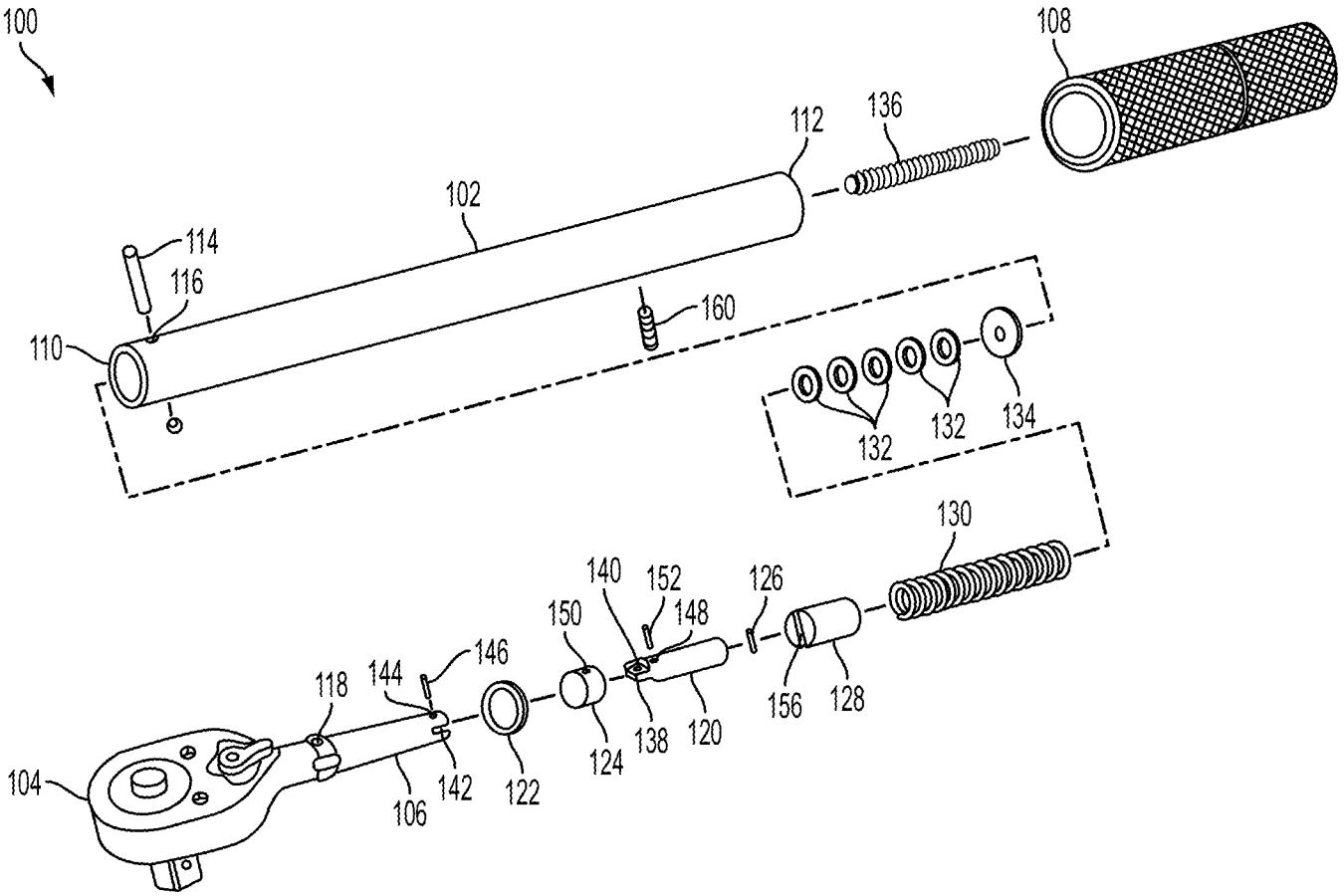
FIG. 1 illustrates an exploded perspective view of a mechanical torque wrench according to aspects of the present application.

While this disclosure is susceptible of embodiments in many different forms, there is shown in the drawings and will herein be described in detail a certain embodiment of the disclosure with the understanding that the present disclosure is to be considered as an exemplification, and is not intended to limit the broad aspect of the disclosure to embodiments illustrated.

The present application discloses a tool, such as a mechanical torque wrench. Common mechanical torque wrenches wear excessively in the cam, pawl, secondary arm and tube interior. This wear causes the mechanical torque wrenches to loose accuracy over time with normal use. This normal loss of accuracy over time causes the need for the wrench to be recalibrated annually or after about 5,000 cycles of use. Current attempts at reducing this wear include using expensive specialty steel materials and heat treatment, which can further degrade or deform the components.

The mechanical torque wrench disclosed herein addresses these issues by electroplating one or more components of the tool with zinc, and negating the need for heat treatment, to improve the performance and life of the mechanical torque wrench. For example, a tube of the mechanical torque wrench may be made of a standard AISI or SAE 1018 and/or AISI or SAE 1020 steel, and the interior surface, or portions thereof, may be electroplated with zinc. Additional components, such as a secondary arm, a pawl, and a cam of the wrench may also be electroplated with zinc. The electroplated zinc layer provides a corrosion-resistant, softer and smoother surface for these components. The electroplated zinc layer also serves as a friction reducer when the zinc oxidizes to form zinc oxide, which further improves the accuracy and life of the mechanical torque wrench.

As an example of a tool that may include components that are electroplated with zinc according to the disclosure, a tool 100 is described with reference to FIG. 1. The tool 100, such as a click-type mechanical torque wrench, includes an elongated tube 102, a head portion 104 adapted to engage a workpiece and including a pivot arm 106, and a handle portion 108. The pivot arm 106 is received in a first end 110 of the tube 102 and the handle is coupled on or to a second end 112 of the tube 102.

As illustrated, the head 104 is a ratcheting-type head. However, the head may be other types of heads, for example, a ratcheting head, a fixed non-ratcheting head, an open ended head, and other heads capable of engaging a workpiece in a well-known manner. The pivot arm 106 is disposed in the first end 110 and a pivot pin 114 is disposed in an aperture 116 of the tube 102 and a corresponding aperture 118 of the pivot arm 106 to couple the head 104 to the tube 102 and allow for pivotal movement about an axis of the pivot pin 114.

The tool 100 may also include additional components adapted to provide the click mechanism, such as a secondary arm 120, an O-ring 122, a fulcrum 124, a pawl 126, a bias member 130, one or more washers 132, one or more thrust washers 134, and a set screw plug 136. As illustrated in FIG. 1, these components may be disposed in an interior of the tube 102 when the tool 100 is assembled.

In an aspect, the secondary arm 120 includes a tongue 138 having an aperture 140, and an end of the pivot arm 106 distal to the head 104 includes a notch 142 and a corresponding aperture 144. The notch 142 is adapted to receive the tongue portion 138 of the secondary arm 120 and a coupling pin 146 extends through the apertures 144 and 140 to form a pivotal connection between the pivot arm 106 and the secondary arm 120. The secondary arm 120 may be disposed or mounted in the O-ring 122 and fulcrum 124. The secondary arm 120 and fulcrum 124 may include apertures 148 and 150, respectively, adapted to receive pin 152 to allow for pivotal movement about an axis of the pin 152.

The secondary arm 120 may also include a recess 154 (illustrated in FIG. 3) extending diametrically across an end face of the secondary arm 120 distal to the tongue 138 and adapted to receive the pawl 126. The cam 128 may also include a corresponding recess 156 in an end face proximal to and facing the recess 154 and adapted to receive the pawl 126. The recess 156 may have a flat base surface and opposing ramped side surfaces (as illustrated in FIG. 4). The pawl 126 may be seated between the secondary arm 120 and the cam 128 in the recesses 154 and 156.

The cam 128 is biased toward the secondary arm 120 by a bias member 130, such as a spring, disposed in the tube 102 and having one end disposed against the cam 128 and the other end disposed against an adjustment mechanism. The adjustment mechanism may allow for the setting and calibrating of the compression of the bias member 130 to set the torque level at which the tool 100 will "click." As illustrated in FIG. 1, the adjustment mechanism may include one or more washers 132, one or more thrust washers 134, and a set screw plug 136. The set screw plug 136 may be disposed in the tube 102 in a threaded aperture 158 (illustrated in FIG. 2) in the interior of the tube 102. The washers 132 and 134 may be disposed in the interior of the tube 102 proximal to the set screw plug 136. As the set screw plug 136 is threaded further into an interior of the tube 102 the compression of the bias member 130 may increase. A setscrew 160 may be inserted into a threaded aperture 162 (illustrated in FIG. 2) in a sidewall of the tube 102 to hold the setscrew plug 136 at a desired position, thereby setting the amount of compression of the bias member 130 and the torque level at which the tool 100 will "click."

In an aspect, the force of the bias member 130 holds the pawl 126 seated in the recesses 154 and 156 of the secondary arm 120 and the cam 128, respectively. When torque is applied to a workpiece using the tool 100, the torque attempts to pivot the pivot arm 106 and the secondary arm 120. When the force of the bias member 130 is overcome, the pivot arm 106 and secondary arm 120 pivot shifting the pawl 126 and move the cam 128 against the force of the bias member 130. The pivot arm 106 may then abut an interior surface of the tube 102 causing the "click" sound. When the torque is released, the cam 128 is driven back into position resetting the pawl 126 and the secondary arm 120.

Mechanical torque wrenches of the type described above with reference to FIG. 1, tend to wear the surfaces if the cam, pawl, secondary arm and tube interior due to the frictional interactions of these components during use of these types of mechanical torque wrenches. This wear can cause the mechanical torque wrenches to loose accuracy over time with normal use or eventually fail.

It has been found that this wear of these components may be limited or reduced by electroplating one or more components of the torque wrenches, such as the interior of the tube, the secondary arm, the cam, and the pawl, with a zinc layer. The electroplated zinc layer provides a softer, smoother surface for these components, and moreover serves as a friction reducer when the zinc oxidizes to form zinc oxide, which improves the accuracy life of the mechanical torque wrench.

Figure 2:
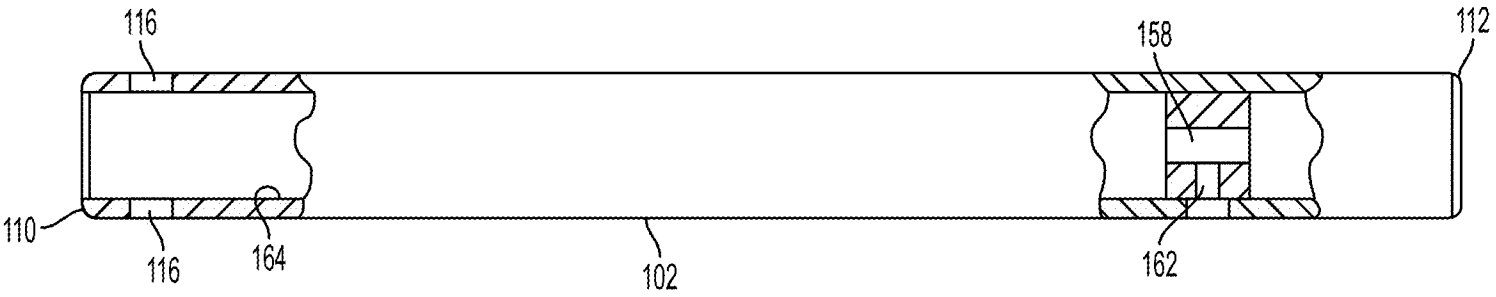
FIG. 2 illustrates a partial cross-sectional view of a tube of the mechanical torque wrench according to aspects of the present application.

Referring to FIGS. 1 and 2, the tube 102 includes an interior surface 164. This interior surface 164 may be contacted by the pivot arm 106, the secondary arm 120, the cam 128, and other components within the tool 100. To reduce the amount of wear and improve the accuracy life of the tool 100, the tube 102 may be constructed of a standard AISI or SAE 1018 and/or AISI or SAE 1020 steel and the interior surface 164, or a portion thereof, may be electroplated with a zinc layer. In an aspect, the zinc layer may have a depth of about 0.0005 inches to about 0.0015 inches. The electroplating of the zinc layer on the interior surface 164 may result in a structured hardness of about 11+/−2 RC at a core of the tube and about 19+/−2 RC (both RC's converted from the Brinell hardness) at an exterior of the interior surface 164.

Figure 3:
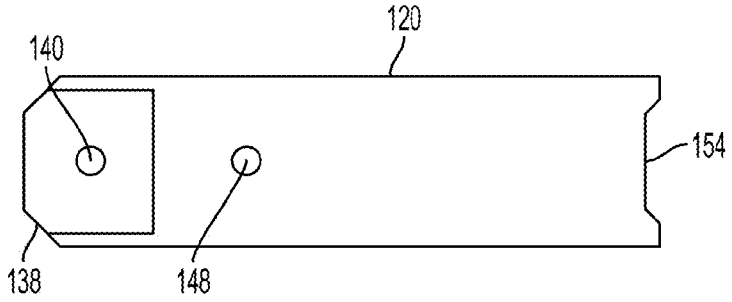
FIG. 3 illustrates an enlarged view of a secondary arm of the mechanical torque wrench according to aspects of the present application.
Figure 4:
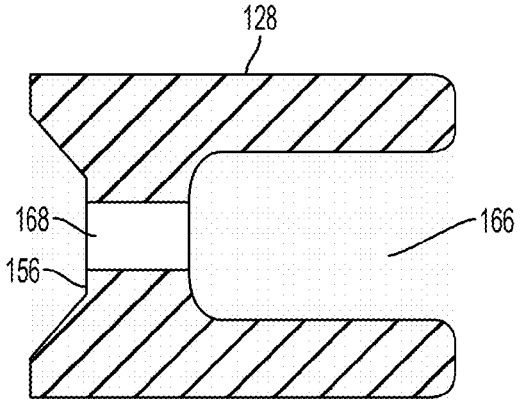
FIG. 4 illustrates an enlarged cross-sectional view of a cam of the mechanical torque wrench according to aspects of the present application.

Referring to FIGS. 1 and 3, the secondary arm 120 may have a generally cylindrical shape with the tongue 138 at one end and the recess 154 at the opposite end. The recess 154 may have a flat base surface and opposed ramped side surfaces. To reduce the amount of wear and improve the accuracy life of the tool 100, the surface of the secondary arm 120 may be electroplated with a zinc layer. In an aspect, the zinc layer may have a depth of about 0.0005 inches to about 0.0015 inches. The electroplating of the zinc layer on the surface of the secondary arm 120 may result in a surface barrier hardness of about 12+/−2 RC. The zinc may also smooth the surfaces of the secondary arm 120. For example, the secondary arm 120 may be constructed of a composition of powered metal(s), and the nature of such a composition generally results in a finish of about 32 Root Mean Square (RMS) without the zinc layer and about 22 RMS after the electroplating of the zinc layer.

Referring to FIGS. 1 and 4, the cam 128 may have a generally cylindrical shape with the recess 156 at one end and a cavity 166 at the opposite end. The recess 156 may have a flat base surface and opposed sloping side surfaces. The cavity 166 may be in communication with the recess 156 via a vent aperture 168. The vent aperture 168 is adapted to relieve differential pressure from building up within the tool 100 and causing inaccurate torque measure.

Figure 5:
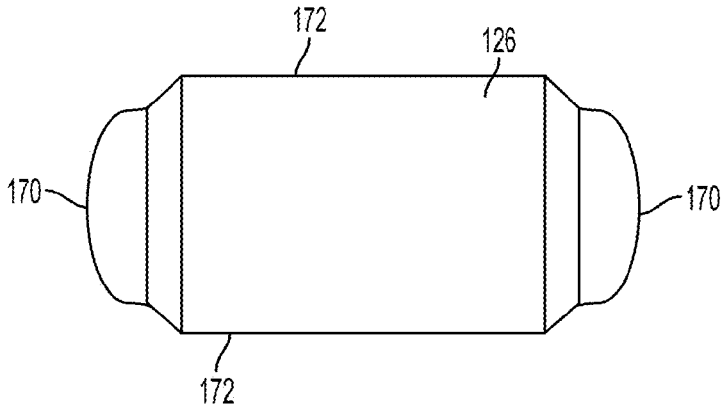
FIG. 5 illustrates an enlarged plan view of a pawl of the mechanical torque wrench according to aspects of the present application.

Referring to FIGS. 1 and 5, the pawl 126 may be an elongated block which is substantially square in transverse cross section with rounded ends 170. The pawl 126 may also include opposed flat faces 172 with the faces being normally seated against the base surfaces of the recesses 154 and 156.

Similar to the secondary arm 120, the respective surfaces of the cam 128 and the pawl 126 may be electroplated with zinc to reduce the amount of wear and improve the accuracy life of the tool 100. The zinc layers may have a depth of about 0.0005 inches to about 0.0015 inches. The electroplating of the zinc on the cam 128 and the pawl 126 may result in a surface barrier hardness of about 12+/−2 RC. The zinc may also smooth the surfaces of the cam 128 and the pawl 126. For example, the cam 128 and the pawl 126 may be constructed of a composition of powered metal(s), and the nature of such a composition generally results in a finish of about 69 RMS without the zinc layer and about 22 RMS after the electroplating of the zinc layer.

Figure 6:
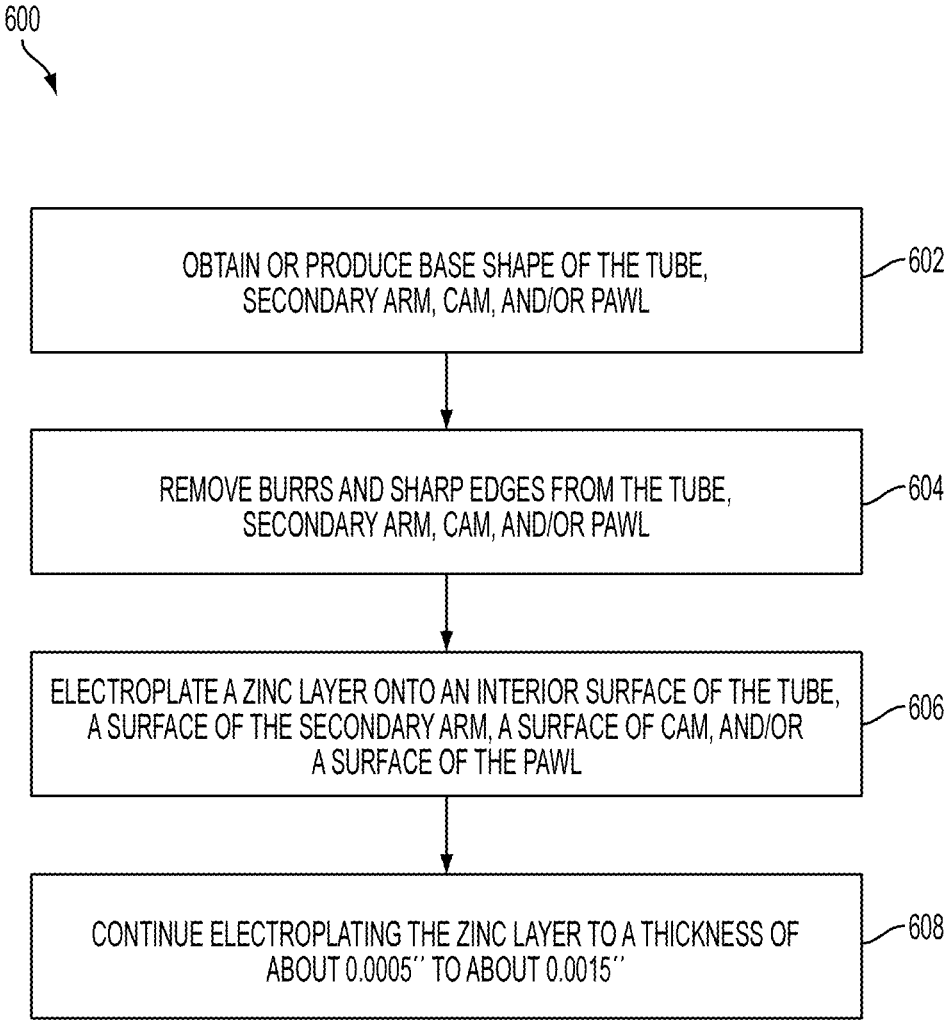
FIG. 6 illustrates an exemplary flow diagram of a method of electroplating components of the mechanical torque wrench according to aspects of the present application.

A method 600 of manufacturing a torque wrench is described with reference to FIG. 6. In block 602, a base shape or component of the tube, the secondary arm, the cam, and/or the pawl is obtained or produced. Burrs and sharp edges are removed from the base component of the tube, the secondary arm, the cam, and/or the pawl, illustrated as block 604. A zinc layer is electroplated on an interior surface of the tube, a surface of the secondary arm, a surface of the cam, and/or a surface of the pawl, illustrated as block 606. Electroplating of the zinc is continued until the zinc layers reach a thickness of about 0.0005 inches to about 0.0015 inches, illustrated as block 608. The components may then be assembled as described above to for the tool 100 and used to apply torque to a workpiece.

The electroplating of the zinc layer on the components causes the interacting surfaces, for example the interior surface 164 of the tube 102, the secondary arm 120, the cam 128, and the pawl 126, to have a similar effective hardness and decreased friction. This improves the wear properties of the tool 100. The zinc layer also acts to reduce or prevent the oxidation of the protected metals by serving as a sacrificial anode even if the surface zinc layer is worn through. Moreover, as the zinc oxidizes over time to form zinc oxide and begins to break down into a fine white powder, it acts to further reduce friction on the affected areas.

Figure 7:
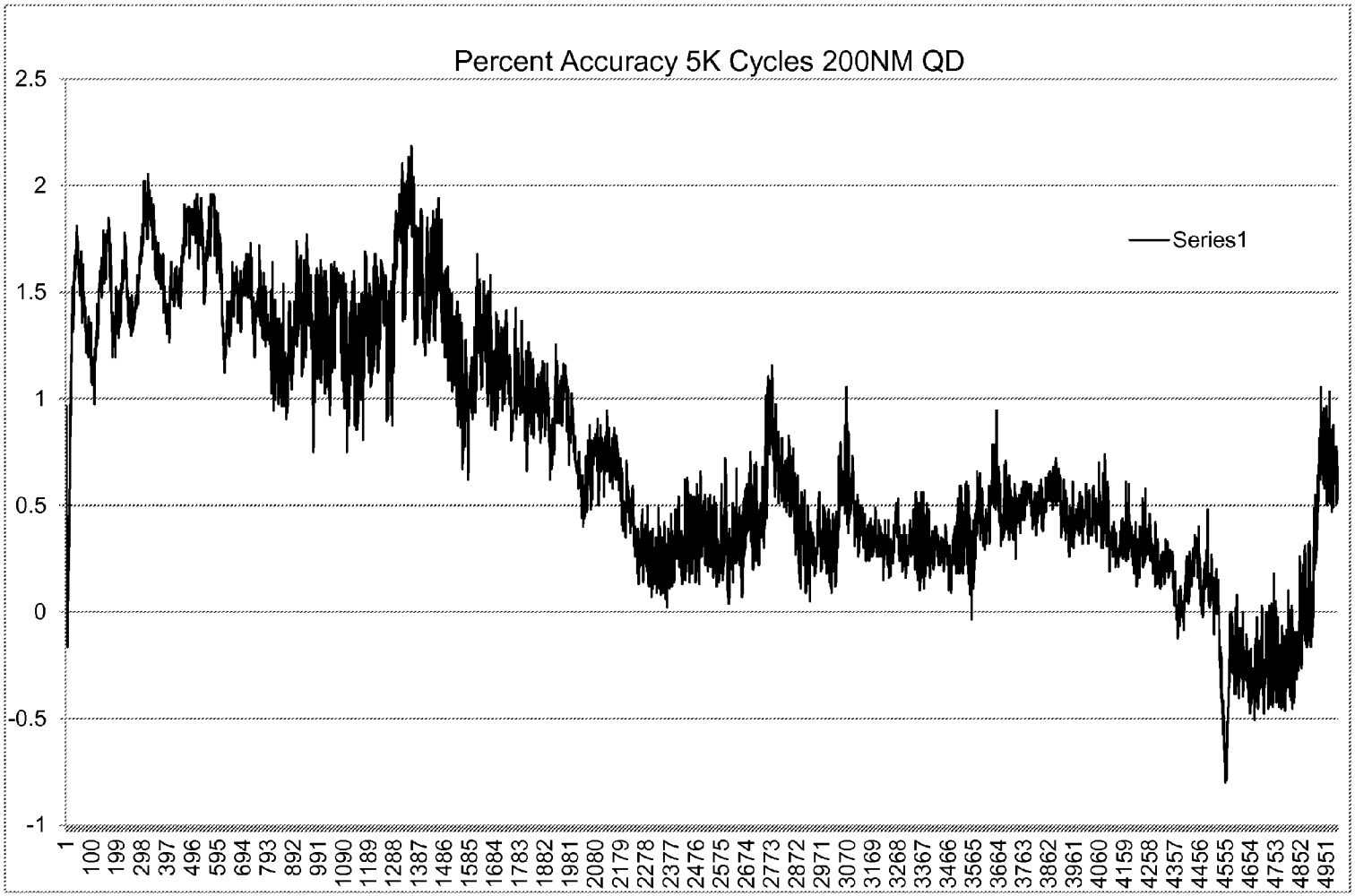
FIGS. 7-10 illustrate graphs of experimental results of the mechanical torque wrench according to aspects of the present application.
Figure 8:
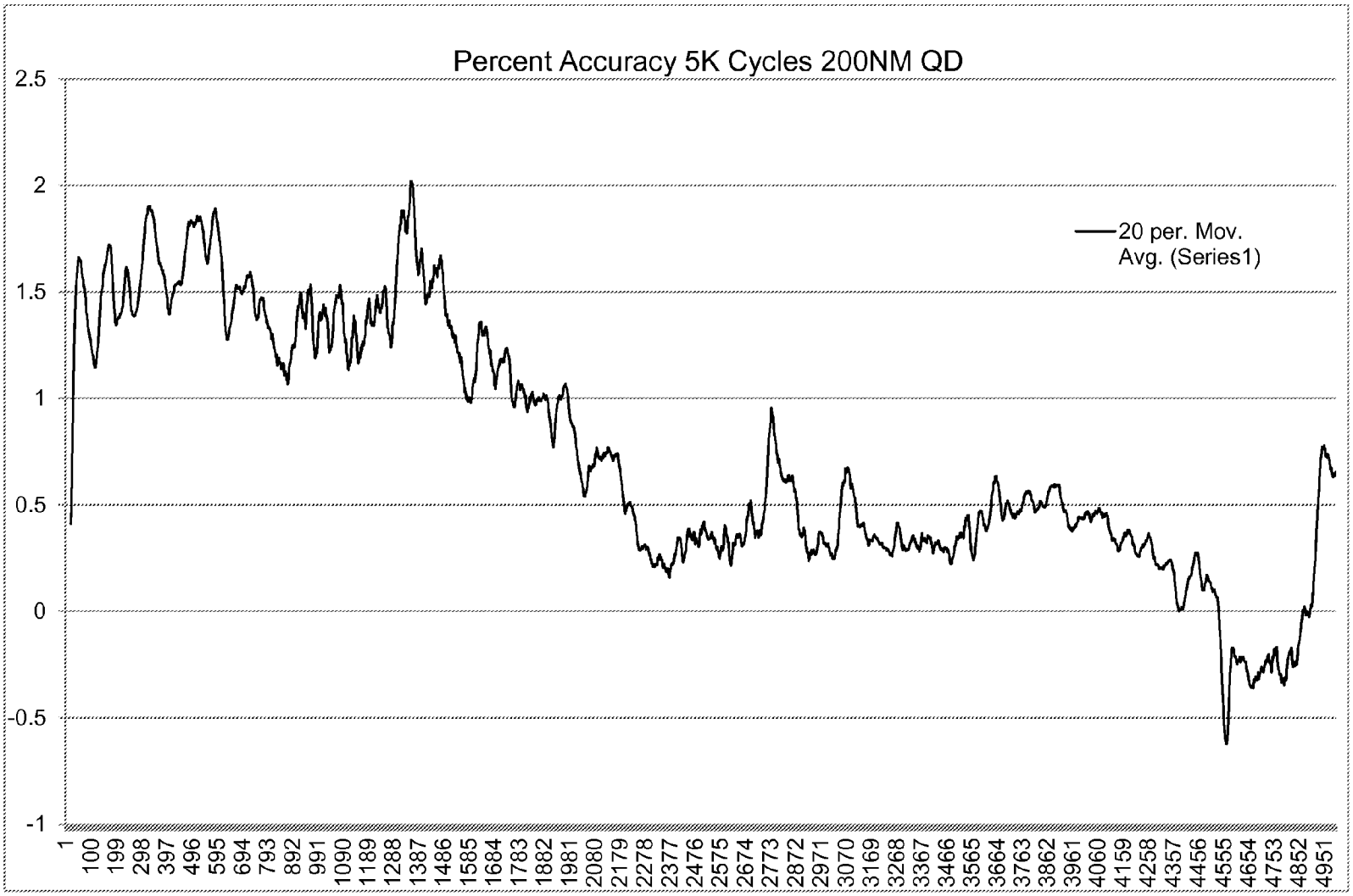
Figure 9:
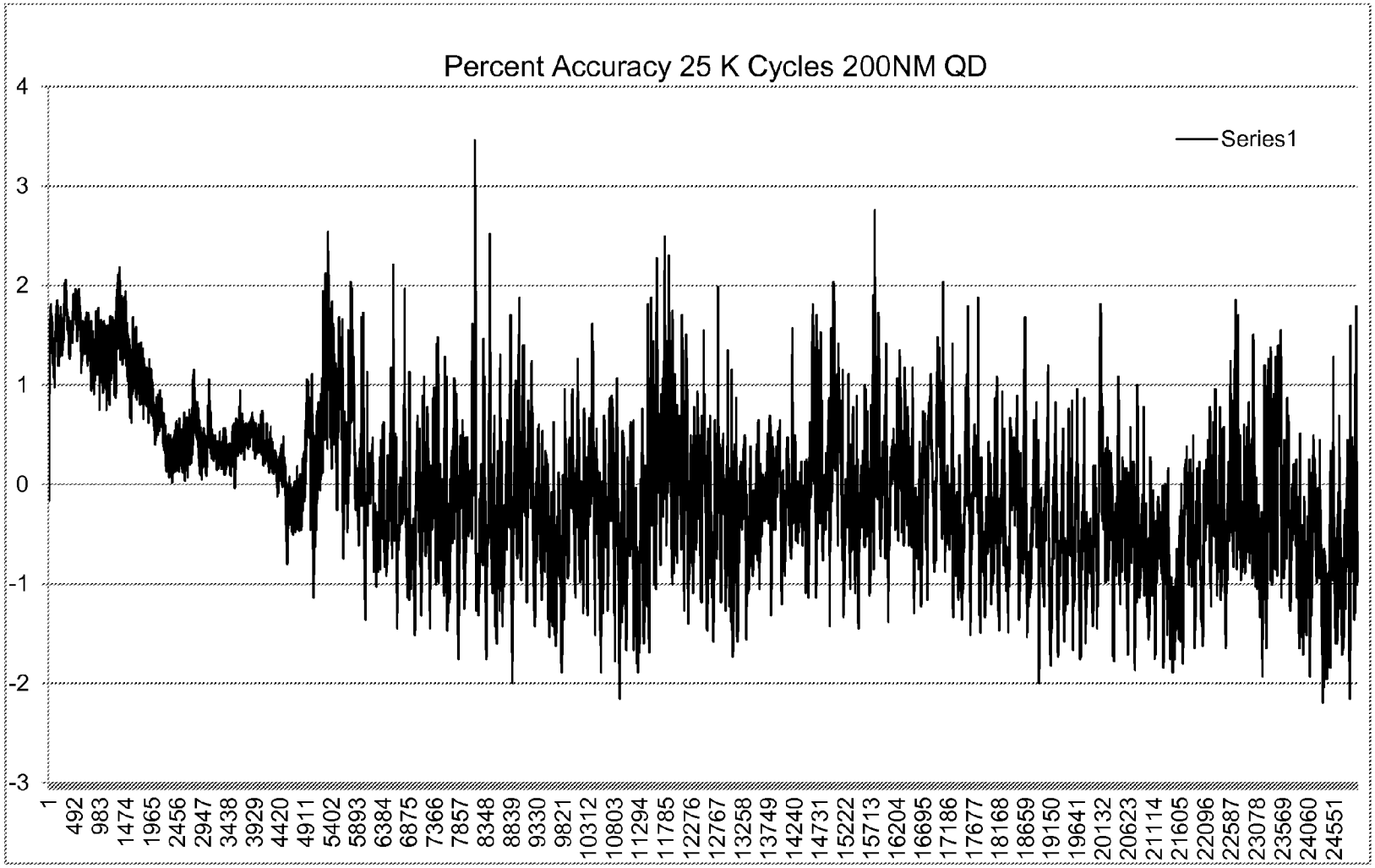
Figure 10:
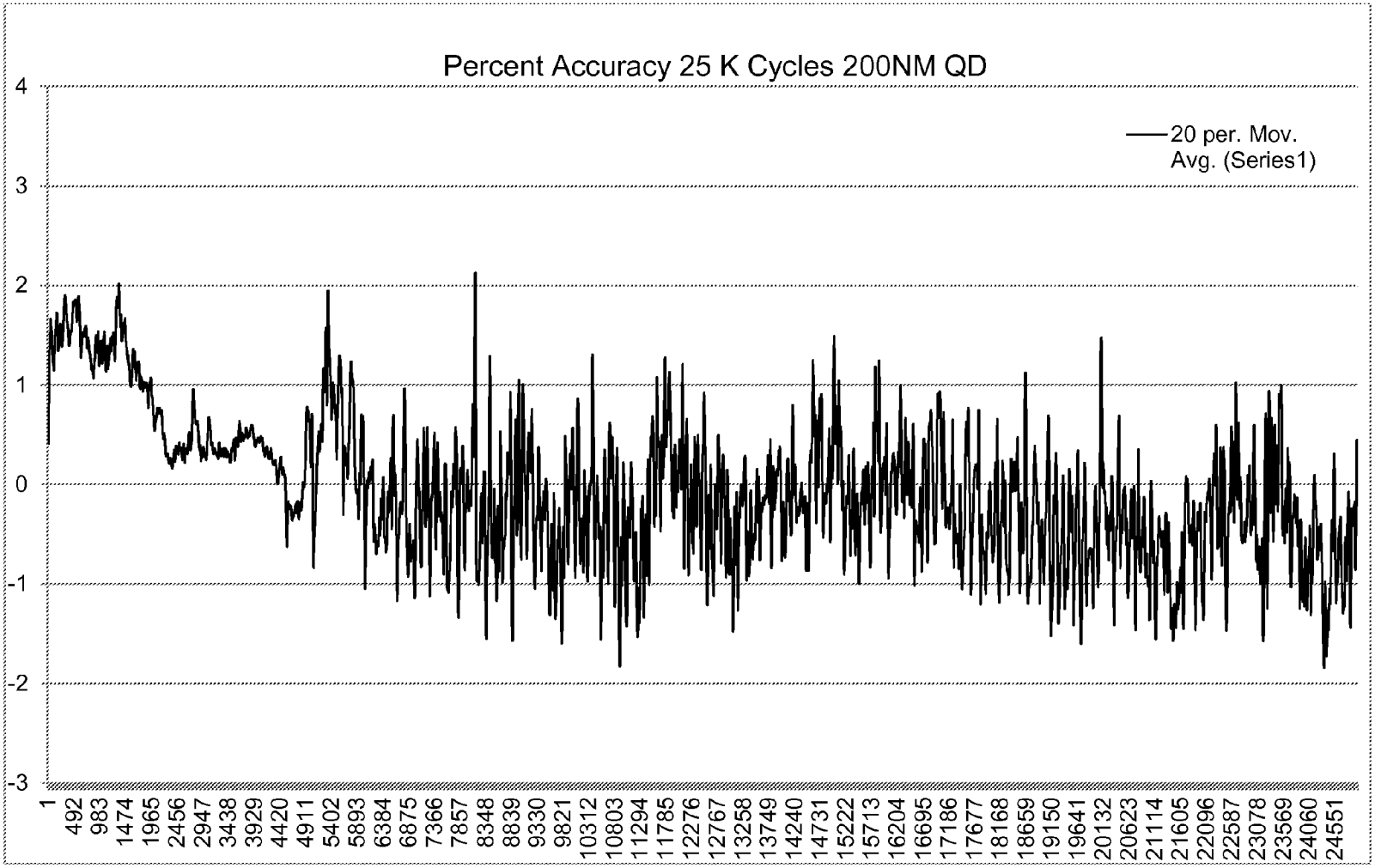

Referring to FIGS. 7-10, the components electroplated with zinc cause an increase in the accuracy lifetime. For example, as illustrated in FIGS. 7 and 8, the percent accuracy of the torque wrench remains relatively the same (within a margin of error of about +/−2 percent) through 5,000 cycles of use without recalibration. Further, as illustrated in FIGS. 9 and 10, the percent accuracy of the torque wrench remains relatively the same (within a margin of error of about +/−2 to 3 percent) through 25,000 cycles of use without recalibration. As described above, common mechanical torque wrenches generally require recalibration after 5,000 cycles of use. Thus, the tools described herein exhibit at least an accuracy life about 5 times greater than the common mechanical torque wrenches.

While the methods of electroplating the surfaces of interacting parts is described above with reference to the tool 100, it should be appreciated that the method may be used to improve the wear properties and lifetime of other types of torque wrenches and other types of tools. For example, the methods may be used to improve electronic torque wrenches, ratchet wrenches, and other tools including interacting parts that are subject to wear over time.

The manner set forth in the foregoing description and accompanying drawings and examples, is offered by way of illustration only and not as a limitation. More particular embodiments have been shown and described, and it will be apparent to those skilled in the art that changes and modifications may be made without departing from the broader aspects of the disclosure. The actual scope of the protection sought is intended to be defined in the following claims when viewed in their proper prospective based on the prior art.

What is claimed is:

1. A method for improving wear properties of a torque wrench, comprising:

obtaining a tube component of the torque wrench, the tube component adapted to house internal components of the torque wrench and couple to a head adapted to engage a workpiece; and electroplating at least a portion of an interior surface of the tube component with zinc to form a first zinc layer.

2. The method of claim 1, wherein the first zinc layer has a thickness of about 0.0005 inches to about 0.0015 inches.

3. The method of claim 1, wherein the first zinc layer has a Rockwell C hardness of about 17 to about 22.

4. The method of claim 1, further comprising:

obtaining a secondary arm component of the torque wrench, the secondary arm component adapted to be housed within the tube component and couple to the head, the secondary arm component further adapted to interact with a pawl component and a cam component of the torque wrench to provide a click mechanism; and electroplating a surface of the secondary arm component with zinc to form a second zinc layer.

5. The method of claim 4, wherein the second zinc layer has a Rockwell C hardness of about 10 to about 14.

6. The method of claim 4, wherein the second zinc layer has a surface finish of about 22 Root Mean Square (RMS).

7. The method of claim 1, further comprising:

obtaining a cam component of the torque wrench, the cam component adapted to be housed within the tube component and interact with a pawl component and a secondary arm component of the torque wrench to provide a click mechanism; and electroplating a surface of the cam component with zinc to form a third zinc layer.

8. The method of claim 7, wherein the third zinc layer has a Rockwell C hardness of about 10 to about 14.

9. The method of claim 7, wherein the third zinc layer has a surface finish of about 22 RMS.

10. The method of claim 1, further comprising:

obtaining a pawl component of the torque wrench, the pawl component adapted to be housed within the tube component and seated between a secondary arm component and a cam component of the torque wrench, the pawl component further adapted to interact with a secondary arm component and a cam component of the torque wrench to provide a click mechanism; and electroplating a surface of the pawl component with zinc to form a fourth zinc layer.

11. The method of claim 10, wherein the fourth zinc layer has a Rockwell C hardness of about 10 to about 14.

12. The method of claim 10, wherein the fourth zinc layer has a surface finish of about 22 RMS.

13. A method for improving wear properties of a torque wrench, comprising:

obtaining a tube component, a secondary arm component, a cam component, and a pawl component of the torque wrench, wherein the tube component is adapted to house the secondary arm, cam, and pawl components and couple to a head adapted to engage a workpiece, the secondary arm component adapted to couple to the head, the pawl component adapted to be seated between the secondary arm and cam components, and the tube, secondary arm, cam, and pawl components further adapted to interact to provide a click mechanism;

removing burrs from each of the tube, secondary arm, cam, and pawl components; and electroplating an interior surface of the tube component and respective surfaces of the secondary arm, cam, and pawl components with zinc, thereby forming respective zinc layers on the surfaces.

14. The method of claim 13, wherein the zinc layers have a thickness of about 0.0005 inches to about 0.0015 inches.

15. The method of claim 13, wherein the zinc layer of the interior surface of the tube component has a Rockwell C hardness of about 17 to about 22.

16. The method of claim 13, wherein the respective zinc layers of the surfaces of the secondary arm, the cam, and the pawl components have a Rockwell C hardness of about 10 to about 14.

17. The method of claim 13, wherein the respective zinc layers of the surfaces of the secondary arm, the cam, and the pawl components includes have a surface finish of about 22 Root Mean Square (RMS).

18. A torque wrench, comprising:

a head adapted to engage a workpiece and a pivot arm;

a tube portion having an interior surface electroplated with a first zinc layer and adapted to receive the pivot arm and couple the head to the tube portion;

a secondary arm having a surface electroplated with a second zinc layer and disposed in the tube portion and adapted to couple to the pivot arm;

a cam having a surface electroplated with a third zinc layer and disposed in the tube portion;

a bias member disposed in the tube portion and adapted to apply a bias force to the cam and bias the cam toward the secondary arm;

a pawl having a surface electroplated with a fourth zinc layer and disposed in the tube portion and seated between the secondary arm and the cam, wherein the cam is adapted to move against the bias force when the secondary arm shifts the pawl in response to a preset torque level being achieved.

19. The torque wrench of claim 18, wherein the first zinc layer has a Rockwell C hardness of about 17 to about 22.

20. The torque wrench of claim 18, wherein each of the second, third and fourth zinc layers has a Rockwell C hardness of about 10 to about 14.

* * * * *